US012016513B2

(12) United States Patent
Dery et al.

(10) Patent No.: US 12,016,513 B2
(45) Date of Patent: Jun. 25, 2024

(54) AUTOMATED DEVICE AND METHOD FOR SPREADING ENVIRONMENTAL FRIENDLY MICROBES ON A SURFACE

(71) Applicant: Ecological Balancing Technologies Corporation, Wilmington, DE (US)

(72) Inventors: Taly Dery, Davie, FL (US); Michael Hoffman, Moshav Udim (IL)

(73) Assignee: Ecological Balancing Technologies Corporation, Wilmington, DE (US)

( * ) Notice: Subject to any disclaimer, the term of this patent is extended or adjusted under 35 U.S.C. 154(b) by 655 days.

(21) Appl. No.: 17/057,727

(22) PCT Filed: May 20, 2019

(86) PCT No.: PCT/IB2019/054141
§ 371 (c)(1),
(2) Date: Nov. 23, 2020

(87) PCT Pub. No.: WO2019/224691
PCT Pub. Date: Nov. 28, 2019

(65) Prior Publication Data

US 2021/0204774 A1 Jul. 8, 2021

Related U.S. Application Data

(60) Provisional application No. 62/674,046, filed on May 21, 2018.

(51) Int. Cl.
*A47L 7/00* (2006.01)
*A47L 9/28* (2006.01)

(52) U.S. Cl.
CPC ..... *A47L 7/0061* (2013.01); *A47L 9/2826* (2013.01); *A47L 9/2831* (2013.01); *A47L 9/2847* (2013.01); *A47L 9/2894* (2013.01)

(58) Field of Classification Search
CPC ..... A47L 7/0061; A47L 7/04; A47L 9/2826; A47L 9/2831; A47L 9/2847;
(Continued)

(56) References Cited

U.S. PATENT DOCUMENTS 2,293,722 A 8/1942 Erickson
D221,836 S 9/1971 Giles et al.
(Continued)

FOREIGN PATENT DOCUMENTS

CN 1177636 4/1998
CN 1642827 7/2005
(Continued)

OTHER PUBLICATIONS

Restriction Official Action dated Jul. 7, 2021 from the US Patent and Trademark Office Re. U.S. Appl. No. 17/019,280. (5 pages).
(Continued)

*Primary Examiner* — Eric J Rosen
*Assistant Examiner* — Michael A Gump

(57) ABSTRACT

A vacuum cleaner includes a housing that houses a suction nozzle and a fan and is configured to be moved on a surface to be cleaned, a cartridge including a solution, a spray nozzle that directs a spray on the surface, a valve that actuates the spray nozzle and a controller that selectively operates the valve based on pre-programmed instructions. The spray nozzle is positioned on the housing in a direction away from a direction of movement of the housing.

21 Claims, 6 Drawing Sheets

(58) Field of Classification Search
CPC .... A47L 9/2894; A47L 9/2805; A47L 9/2821; A47L 9/2836; A47L 2201/06; A47L 11/201; A47L 11/408; A47L 11/4083
USPC ..... 15/322
See application file for complete search history.

(56) References Cited

U.S. PATENT DOCUMENTS

| | | | | |
|---|---|---|---|---|
| 3,675,832 | A | 7/1972 | Ruscitti | |
| D239,922 | S | 5/1976 | Utley | |
| D250,394 | S | 11/1978 | Menius | |
| 4,164,055 | A * | 8/1979 | Townsend | A47L 11/30 15/353 |
| 4,245,788 | A | 1/1981 | Wright | |
| D279,452 | S | 7/1985 | Beechuk | |
| D284,362 | S | 6/1986 | Biesecker | |
| D309,711 | S | 8/1990 | Biesecker | |
| D376,760 | S | 12/1996 | Sykes | |
| D433,336 | S | 11/2000 | Weber | |
| 6,405,944 | B1 | 6/2002 | Benalikhoudja | |
| D472,471 | S | 4/2003 | McClure et al. | |
| D473,143 | S | 4/2003 | McClure et al. | |
| D489,992 | S | 5/2004 | Brauner et al. | |
| D571,662 | S | 6/2008 | Clark et al. | |
| 7,858,336 | B1 | 12/2010 | Garner et al. | |
| D630,946 | S | 1/2011 | Crawford | |
| D656,599 | S | 3/2012 | Browder | |
| D663,215 | S | 7/2012 | Clay et al. | |
| D667,101 | S | 9/2012 | Browder | |
| D673,253 | S | 12/2012 | Mack | |
| D678,496 | S | 3/2013 | Browder | |
| 8,986,610 | B2 | 3/2015 | Ben Haim | |
| 9,486,552 | B1 | 11/2016 | Ansley et al. | |
| 9,573,750 | B2 | 2/2017 | Seling et al. | |
| D805,909 | S | 12/2017 | Matsuishi | |
| D875,532 | S | 2/2020 | Lehanneur | |
| D879,613 | S | 3/2020 | Lehanneur | |
| 10,814,028 | B2 | 10/2020 | Becker | |
| 2002/0042965 | A1* | 4/2002 | Salem | A47L 11/4044 15/339 |
| 2003/0189066 | A1 | 10/2003 | Schiller | |
| 2004/0221415 | A1* | 11/2004 | Tondra | A47L 9/2821 15/319 |
| 2005/0160553 | A1* | 7/2005 | Gregory | A47L 7/0038 15/320 |
| 2005/0252930 | A1 | 11/2005 | Contadini et al. | |
| 2007/0217945 | A1* | 9/2007 | Selander | A61L 9/14 422/5 |
| 2008/0216273 | A1* | 9/2008 | Medema | A47L 9/0653 15/246.2 |
| 2009/0238716 | A1 | 9/2009 | Weening | |
| 2009/0265876 | A1* | 10/2009 | Gardner | B08B 13/00 15/322 |
| 2009/0324815 | A1 | 12/2009 | Nielsen et al. | |
| 2010/0021576 | A1 | 1/2010 | Chang et al. | |
| 2011/0214245 | A1* | 9/2011 | Bassett | A47L 7/04 15/320 |
| 2012/0152882 | A1 | 6/2012 | Tune | |
| 2012/0168971 | A1 | 7/2012 | Hansen et al. | |
| 2013/0015956 | A1 | 1/2013 | Wegelin et al. | |
| 2013/0068783 | A1 | 3/2013 | Gasper et al. | |
| 2014/0007866 | A1 | 1/2014 | Yuki | |
| 2014/0263426 | A1 | 9/2014 | Gasper | |
| 2016/0073844 | A1* | 3/2016 | Park | G06F 16/583 15/319 |
| 2016/0101925 | A1 | 4/2016 | Franz et al. | |
| 2016/0183538 | A1 | 6/2016 | Taghavi et al. | |
| 2016/0325055 | A1 | 11/2016 | Cameron | |
| 2017/0000305 | A1* | 1/2017 | Gordon | A47L 5/30 |
| 2017/0035262 | A1 | 2/2017 | Li et al. | |
| 2017/0035925 | A1 | 2/2017 | Sevy | |
| 2017/0348364 | A1 | 12/2017 | Garner et al. | |
| 2018/0368312 | A1* | 12/2018 | Strang | A47L 9/2805 |
| 2020/0405781 | A1 | 12/2020 | Holzapfel et al. | |
| 2020/0407807 | A1 | 12/2020 | Holzapfel et al. | |
| 2020/0407808 | A1 | 12/2020 | Holzapfel et al. | |
| 2020/0407809 | A1 | 12/2020 | Holzapfel et al. | |
| 2021/0046256 | A1 | 2/2021 | Hoffman et al. | |
| 2021/0046497 | A1 | 2/2021 | Hoffman et al. | |

FOREIGN PATENT DOCUMENTS

| | | |
|---|---|---|
| CN | 1934241 | 3/2007 |
| CN | 103589655 | 2/2014 |
| CN | 103703121 | 4/2014 |
| CN | 104487566 | 4/2015 |
| CN | 104688895 | 6/2015 |
| CN | 104736162 | 6/2015 |
| CN | 204501790 | 7/2015 |
| CN | 303340433 S | 8/2015 |
| CN | 105087423 | 11/2015 |
| CN | 105219669 | 1/2016 |
| CN | 205032305 | 2/2016 |
| CN | 107567493 | 1/2018 |
| CN | 107723267 | 2/2018 |
| KR | 20-2009-0007893 | 8/2009 |
| KR | 10-2014-0128870 | 11/2014 |
| KR | 10-2017-0130341 | 11/2017 |
| WO | WO 01/34182 | 5/2001 |
| WO | WO 2016/060934 | 4/2016 |
| WO | WO 2016/118850 | 7/2016 |
| WO | WO 2016/118864 | 7/2016 |
| WO | WO 2019/175774 | 9/2019 |
| WO | WO 2019/175775 | 9/2019 |
| WO | WO 2019/175777 | 9/2019 |
| WO | WO 2019/175777 A8 | 9/2019 |
| WO | WO 2019/175780 | 9/2019 |
| WO | WO 2019/175782 | 9/2019 |
| WO | WO 2019/175782 A8 | 9/2019 |
| WO | WO 2019/175783 | 9/2019 |
| WO | WO 2019/224691 | 11/2019 |
| WO | WO 2019/175783 A8 | 10/2020 |

OTHER PUBLICATIONS

Restriction Official Action dated Jul. 7, 2021 from the US Patent and Trademark Office Re. U.S. Appl. No. 17/019,281. (5 pages).
Notice of Allowance dated Mar. 4, 2022 From the US Patent and Trademark Office Re. U.S. Appl. No. 17/019,280. (7 Pages).
Restriction Official Action dated Mar. 4, 2022 From the US Patent and Trademark Office Re. U.S. Appl. No. 17/019,596. (10 Pages).
Official Action dated May 26, 2022 from US Patent and Trademark Office Re. U.S. Appl. No. 17/019,596. (46 pages).
Examination Report dated Sep. 7, 2018 From the Government of India, Patent Office, Intellectual Property Building Re.: Application No. 309690.
Examination Report fated Sep. 11, 2018 From the Government of India, Patent Office, Intellectual Property Building Re.: Application No. 309744.
International Preliminary Report on Patentability fated Dec. 3, 2020 From the International Bureau of WIPO Re. Application No. PCT/IB2019/054141. (9 Pages).
International Preliminary Report on Patentability dated Sep. 24, 2020 From the International Bureau of WIPO Re. Application No. PCT/IB2019/052007. (6 Pages).
International Preliminary Report on Patentability dated Sep. 24, 2020 From the International Burau of WIPO Re. Application No. PCT/IB2019/052016. (7 Pages).
International Preliminary Report on Patentability dated Sep. 24, 2020 From the International Bureau of WIPO Re. Application No. PCT/IB2019/052008. (6 Pages).
International Preliminary Report on Patentability dated Sep. 24, 2020 From the International Bureau of WIPO Re. Application No. PCT/IB2019/052010. (7 Pages).
International Preliminary Report on Patentability dated Sep. 24, 2020 From the International Bureau of WIPO Re. Application No. PCT/IB2019/052014. (7 Pages).
International Preliminary Report on Patentability dated Sep. 24, 2020 From the International Bureau of WIPO Re. Application No. PCT/IB2019/052017. (7 Pages).

(56) References Cited

OTHER PUBLICATIONS

International Search Report and the Written Opinion dated Jul. 3, 2019 From the International Searching Authority Re. Application No. PCT/IB2019/052014. (16 Pages).
International Search Report and the Written Opinion dated Jul. 3, 2019 From the International Searching Authority Re. Application No. PCT/IB2019/052017. (14 Pages).
International Search Report and the Written Opinion dated Sep. 17, 2019 From the International Searching Authority Re. Application No. PCT/IB2019/054141. (11 Pages).
International Search Report and the Written Opinion dated Jun. 26, 2019 From the International Searching Authority Re. Application No. PCT/IB2019/052016. (15 Pages).
International Search Report and the Written Opinion dated Jun. 27, 2019 From the International Searching Authority Re. Application No. PCT/IB2019/052007. (12 Pages).
International Search Report and the Written Opinion dated Jun. 27, 2019 From the International Searching Authority Re. Application No. PCT/IB2019/052008. (10 Pages).
International Search Report and the Written Opinion dated Jun. 27, 2019 From the International Searching Authority Re. Application No. PCT/IB2019/052010. (17 Pages).
Notice of Allowability dated Apr. 26, 2021 From the US Patent and Trademark Office Re. U.S. Appl. No. 29/640,027. (6 Pages).
Notice of Amendment dated Dec. 11, 2018 From the State Intellectual Property Office of the People's Republic of China Re. Application No. 201830508569.8. (2 pages).
Notification of Reason for Rejection dated Jan. 30, 2019 From the Japanese Patent Office Re. Application No. 2018-019747. (2 Pages).
Official Action dated Jun. 12, 2020 from the US Patent and Trademark Office Re. U.S. Appl. No. 29/640,027. (19 pages).
Official Action dated Jun. 12, 2020 from the US Patent and Trademark Office Re. U.S. Appl. No. 29/640,032. (13 pages).
Official Action dated Jun. 25, 2020 from the US Patent and Trademark Office Re. U.S. Appl. No. 29/653,164. (9 pages).
USPTO Response to Rule 312 Communication dated May 13, 2021 from the US Patent and Trademark Office Re. U.S. Appl. No. 29/640,027. (2 pages).
Cho "Characterization of Potential Probiotics Bacillus Subtilis CS90 From Soybean Paste (Doenjang) and Its Antimicrobial Activity Against Food-Borne Pathogens", Journal of Applied Biological Chemistry, 51(5): 285-291, 2008.
Gu et al. "The Preventive Effect and Therapeutic Effect of Spraying Agent of Bacillus Pab02 on Respiratory Infection in Broilers", Proceedings of the 10th in the 4th National Academic Seminar and Animal Micro-Ecology Enterprise Development Forum, p. 450-458, Aug. 1, 2010.
Jeon et al. "Screening and Characterization of Potential Bacillus Starter Cultures for Fermenting Low-Salt Soybean Past (Doenjang)", Journal of Microbiology and Biotechnology, 26(4): 666-674, Apr. 2016.
Ji et al. "Probiotic Bacillus Amyloliquefaciens SC06 Prevents Bacterial Translocation in Weaned Mice", Indian Journal of Microbiology, 53(3): 323-328, Published Online Mar. 16, 2013.
Wong et al. "An Antifungal Protein From Bacillus Amyloliquefaciens", Journal of Applied Microbiology, 105(6): 1888-1898, Dec. 2008.
Xie et al. "Isolation and Characterization of a Bacteriocin Produced by an Isolated Bacillus Subtilis LFB112 That Exhibits Antimicrobial Activity Against Domestic Animal Pathogens", African Journal of Biotechnology, 8(20): 5611-5619, Oct. 19, 2009.
Notice of Allowance dated Mar. 24, 2022 from US Patent and Trademark Office Re. U.S. Appl. No. 17/019,280. (4 pages).
Restriction Official Action dated Jul. 13, 2021 from the US Patent and Trademark Office Re. U.S. Appl. No. 17/019,568. (5 pages).
Notice of Allowability dated Apr. 20, 2022 from US Patent and Trademark Office Re. U.S. Appl. No. 17/019,568. (4 pages).
Notice of Allowance dated Oct. 26, 2022 from US Patent and Trademark Office Re. U.S. Appl. No. 17/019,596. (9 pages).
Notice of Allowance dated Feb. 16, 2022 From the US Patent and Trademark Office Re. U.S. Appl. No. 17/019,281. (7 Pages).
Official Action dated Sep. 29, 2023 from the US Patent and Trademark Office Re. U.S. Appl. No. 16/980,393. (43 pages).
Restriction Official Action dated Sep. 20, 2023 from the US Patent and Trademark Office Re. U.S. Appl. No. 16/980,394. (11 pages).
Official Action dated Dec. 21, 2023 from the US Patent and Trademark Office Re. U.S. Appl. No. 16/980,394. (44 pages).
Notice of Allowance dated Mar. 9, 2022 together with Interview SUmmary Dated Feb. 16, 2022 from US Patent and Trademark Office Re. U.S. Appl. No. 17/019,568. (9 pages).
Official Action Dated Sep. 22, 2021 from the US Patent and Trademark Office Re. U.S. Appl. No. 17/019,280. (26 pages).
Official Action Dated Sep. 22, 2021 from the US Patent and Trademark Office Re. U.S. Appl. No. 17/019,568. (35 pages).
Notice of Allowance Dated Apr. 24, 2024 from US Patent and Trademark Office Re. U.S. Appl. No. 16/980,393. (9 pages).

* cited by examiner

AUTOMATED DEVICE AND METHOD FOR SPREADING ENVIRONMENTAL FRIENDLY MICROBES ON A SURFACE

RELATED APPLICATION

This application is a National Phase of PCT Patent Application No. PCT/IB2019/054141 having International filing date of May 20, 2019, which claims the benefit of priority under 35 USC § 119(e) from U.S. Provisional Patent Application No. 62/674,046 filed on May 21, 2018. The contents of the above applications are all incorporated by reference as if fully set forth herein in their entirety.

FIELD AND BACKGROUND OF THE INVENTION

The present invention, in some embodiments thereof, relates to an automated device and method for spreading environmental friendly microbes on a surface that is being cleaned and, more particularly, but not exclusively, to the automated device integrated with a vacuum cleaner.

Foul odors, allergens, dust mites and other irritants and contaminants are known to accumulate in indoor environments especially on and under textile surfaces such as rugs, carpets, mattresses. Known method for disinfecting and deodorizing rugs and carpets consist of sprinkling powder on the rug or carpet and then using a vacuum cleaner to vacuum up the powder. Another known method includes spraying shampoo on the surface and then vacuuming up the shampoo. Known methods for removing bedbugs and dust mites from a mattress typically requires rigorous scrubbing before vacuuming or spreading a powder disinfectant and then vacuuming up the powder.

U.S. Patent Application Publication No. 2005/0160553 entitled "Carpet Cleaning Apparatus and Method of Construction," describes a carpet cleaning apparatus and method of retrofitting a vacuum cleaner. The apparatus provides a vacuum cleaner with a sweeper housing carrying a rotating brush assembly for contacting a surface of a carpet. A collection device is carried in the sweeper housing along with a fan assembly. A suction hose is connected in circuit with the fan assembly and the collection device. A pump driven vessel is carried externally to the sweeper housing for fluid communication with a spray nozzle. The spray nozzle is arranged externally to the housing to dispense fluid under pressure a spaced distance from the housing.

U.S. Pat. No. 9,901,235 entitled "Autonomous Robotic Device Capable of Vacuum Cleaning and Purifying Air," describes an autonomous robotic device including an autonomous robotic vacuum cleaner and an air purifier having an air inlet and an air outlet, and provided therein with a blower and a filter, air being driven by the blower to enter the air purifier through the air inlet, be filtered through the filter and then be vented out of the air purifier through the air outlet.

SUMMARY OF THE INVENTION

According to an aspect of some embodiments of the present invention there is provided a device and method for spreading environmental friendly microbes on a surface while the surface is being cleaned. According to some example embodiments, the device is integrated as part of a vacuum cleaner and the spreading is controlled based on one or more sensor readings. According to some example embodiments, the device is configured to spread the microbes in a direction away from an immediate area that is being vacuumed to avoid removal of the microbes from the surface due to vacuuming and intentionally maintain the microbes on the surface after the vacuum cleaning has been completed.

According to some example embodiments, presence of the environmental friendly microbes on the surface is configured to alter the microbe balance and thereby control future accumulation of microbes that may act as contaminants and allergens. The environmental friendly microbes may for example compete with other microbes for space and food and thereby suppress growth of other microbes.

According to an aspect of some example embodiments there is provided a vacuum cleaner that includes: a fan configured to create a suction; a suction nozzle configured to suction debris from a surface based on operation of the fan; a housing configured to house the suction nozzle and to move on a surface to be cleaned; a cartridge configured to store a solution; a spray nozzle positioned on the housing and configured to direct a spray on the surface and in a direction away from a direction of movement of the housing; a valve configured to direct jets of air from the fan to the spray nozzle and thereby actuate spraying of the solution; and a controller configured to selectively operate the valve based on pre-programmed instructions.

Optionally, the solution includes microbes configured to be maintained on the surface after the surface is cleaned.

Optionally, the solution includes an aroma compound configured to provide a fragrance.

Optionally, the spray nozzle is positioned to direct the spray in a direction opposite a direction of movement of the housing.

Optionally, the spray nozzle is positioned to direct the spray laterally with respect to a direction of movement of the housing.

Optionally, the vacuum cleaner includes at least one sensor, wherein the controller is configured to receive input from the at least one sensor and to control operation of the valve based on the input.

Optionally, the at least one sensor is configured to sense that the fan is operative.

Optionally, the at least one sensor is a level sensor configured to sense a level of the solution in the cartridge.

Optionally, the at least one sensor is a camera configured to detect that vacuum cleaner is cleaning a textile surface.

Optionally, the at least one sensor is configured to differentiate between a hard floor and a textile surface.

Optionally, the controller is configured to operate the valve based on the at least one sensor detecting the textile surface.

Optionally, the at least one sensor is remote from the vacuum cleaner and wherein the controller is configured to receive the input via a wireless communication channel.

Optionally, the at least one sensor is selected from a group including: an air quality probe, a humidity detect and a temperature sensor.

Optionally, the controller is configured to alter a frequency of the spraying based on the input.

Optionally, the controller is configured to alter a dose of the spraying based on the input.

Optionally, the cartridge is configured to be replaced based on the solution being exhausted.

According to some example embodiments, there is provided a microbe spreading device including: a cartridge configured to store a solution including microbes; a spray nozzle configured to spray the solution stored in the cartridge; a valve configured to direct a jet of air from a fan, wherein the jet of air is configured to actuate the spray nozzle; a sensor configured to sense that the fan is operative; and a controller configured to control operation of the valve based on input from the sensor.

Optionally, the fan is a suction fan of a vacuum cleaner and wherein the microbe spreading device is integrated on the vacuum cleaner.

Optionally, the device includes a second sensor configured to differentiate between a hard surface and a textile surface and wherein the controller is configured to actuate operation of the valve based on the second sensor identifying the textile surface.

According to an aspect of some example embodiments, there is provided a method for or operating a microbe spreading device with a vacuum cleaner, the method including: actuate a spray nozzle configured to spray a solution including microbes based on a fan of the vacuum cleaner; receive input from at least one sensor, wherein the at least one sensor is configured to sense a surrounding condition; and adjust operation of the spray nozzle based on the input received.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1A:
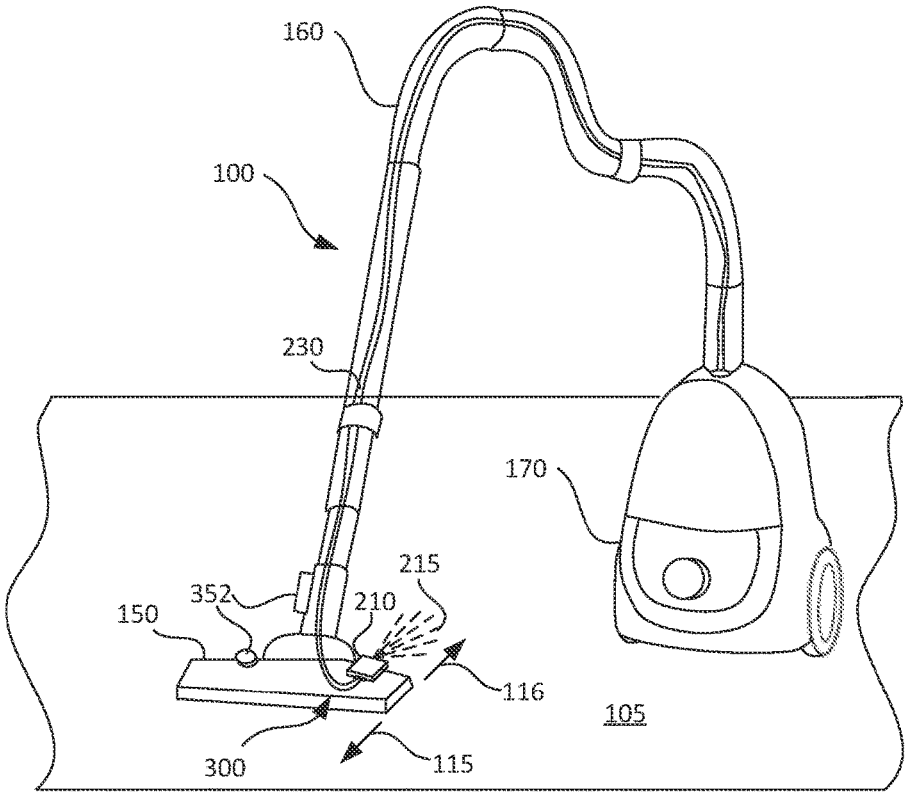
FIGS. 1A, 1B and 1C are simplified drawings of example microbe spreading devices integrated with a vacuum cleaner in accordance with some example embodiments.

The present invention, in some embodiments thereof, relates to an automated device and method for spreading environmental friendly microbes on a surface being cleaned and, more particularly, but not exclusively, to the automated device integrated with a vacuum cleaner.

According to some example embodiments, there is provided a mobile device that is configured to spread environmental friendly microbes on a surface. Optionally, the device is configured to operated as the surface is being cleaned. Optionally, the device is a handheld device. According to some example embodiments, the device includes a cartridge in which a solution including the environmental friendly microbes is stored, a spray nozzle configured for spraying the solution in a desired direction with respect to movement of the device, an actuator configured to actuate the dispensing and a controller configured to control the actuator without any direct human intervention. In some example embodiments, the device is a vacuum cleaner. In other embodiments, the device may be a cleaning device other than a vacuum, e.g. a mop or a broom. In yet other embodiments, the device may be a device that is dedicated to dispensing environmental friendly microbes on a surface.

The cartridge may be a disposable cartridge configured for singe use or may be a cartridge that may be refilled with the solution. The solution may be water based or oil based. In some example embodiments, the solution may be Enviro-Biotics™, sold by BetterAir International Ltd. in Hong Kong. Optionally, the device includes tubing to provide fluid communication between the spray nozzle positioned near the surface being cleaned and the cartridge storing the solution. Optionally, the device includes more than one spray nozzle. In some example embodiments, the spray nozzle is actuated with jets of air generated by a fan of the vacuum cleaner. Alternatively, the device may include a dedicated actuator that is powered with the power source of the vacuum cleaner. Optionally, a vacuum cleaner may be retrofitted with the device.

According to some example embodiments, the microbe spreading device is oriented on the vacuum cleaner to spread the microbes in an area that has already been vacuumed or generally away from an area that is about to be vacuumed. In this manner, the microbes dispensed are not suctioned during the cleaning. In some example embodiments, a spray nozzle of the device is directed in a direction opposite a direction at which the suction head is moving. Optionally, the spray nozzle of the device is directed laterally with respect to a direction at which the suction head is moving. Optionally, the spray nozzle of the device is positioned to spray the microbes on the surface being cleaned at a height of 1-4 cm. According to some example embodiments, the spray nozzle is configured to spray a fine mist that may be relatively easily absorbed in a textile, e.g. rug, carpet, mattress and curtain without significantly wetting the textile. Optionally, once absorbed by a textile material, a subsequent pass of the vacuum cleaner may not lead to suctioning up of the microbes and thereby microbes may be maintained on the surface. Optionally, the mist is configured to be absorbed or to be settled after 0-2 seconds after which suctioning may be applied without removing the microbes. Spreading of the microbes across an extent of a surface may be based on movement of the vacuum cleaner. The vacuum cleaner may be operated by a user or may be self-operated, e.g. a robotic vacuum cleaner.

In some example embodiments, a controller of the microbe spreading device receives input from one or more sensors and is actuated based on the input received. The one or more sensors may include sensors associated with the vacuum cleaner including an air flow sensor to sense air flowing through the vacuum cleaner as an indication to when the vacuum cleaner is turned on, a motion sensor configured to detect movement and/or direction of movement of the suction head piece while vacuuming, and a camera configured to distinguish between different types of surfaces, e.g. tile, wood, carpet and mattress. The one or more sensors may also include sensors associated with environmental conditions in an indoor environment including an air quality probe, a humidity detector and a temperature sensor. The air quality probe may be similar to E4000 indoor air quality probe offered by NanoSense, France. Optionally, the sensors may transmit output to the controller via a wireless communication channel. The one or more sensors may also include sensors associated with the microbe spreading device such as a level sensor configured to monitor level of liquid in a dispenser including the solution being dispensed.

According to some example embodiments, based on input received from the one or more sensors, the controller may automatically (without human intervention) actuate the spray nozzle and may automatically adapt the spraying to the surrounding conditions. In some example embodiments, the controller is configured to actuate the spray nozzle based on detecting that the vacuum cleaner is cleaning a textile surface such as a rug, carpet, mattress and curtain. Optionally, the controller is configured to actuate the spray nozzle while the suction head piece is moving away from a spraying direction and refrain from actuating the spray nozzle while the suction head piece is moving in the spraying direction. Optionally, the controller is configured to alter a rate or frequency at which the spray nozzle spreads the microbes based on a level of air quality detected from a sensor in communication with the controller.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 1B:
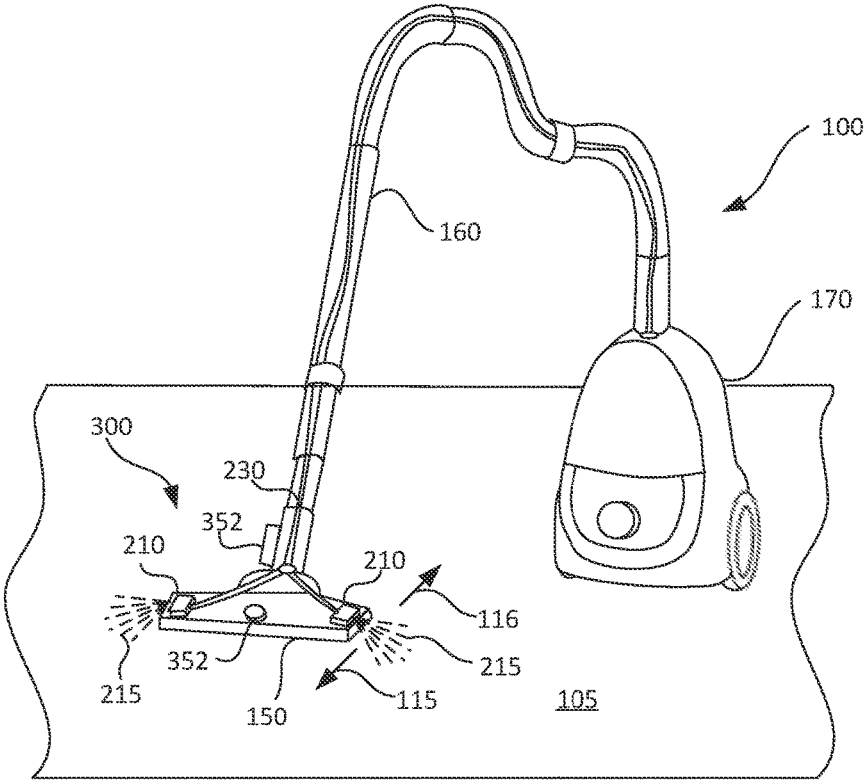
Figure 1C:
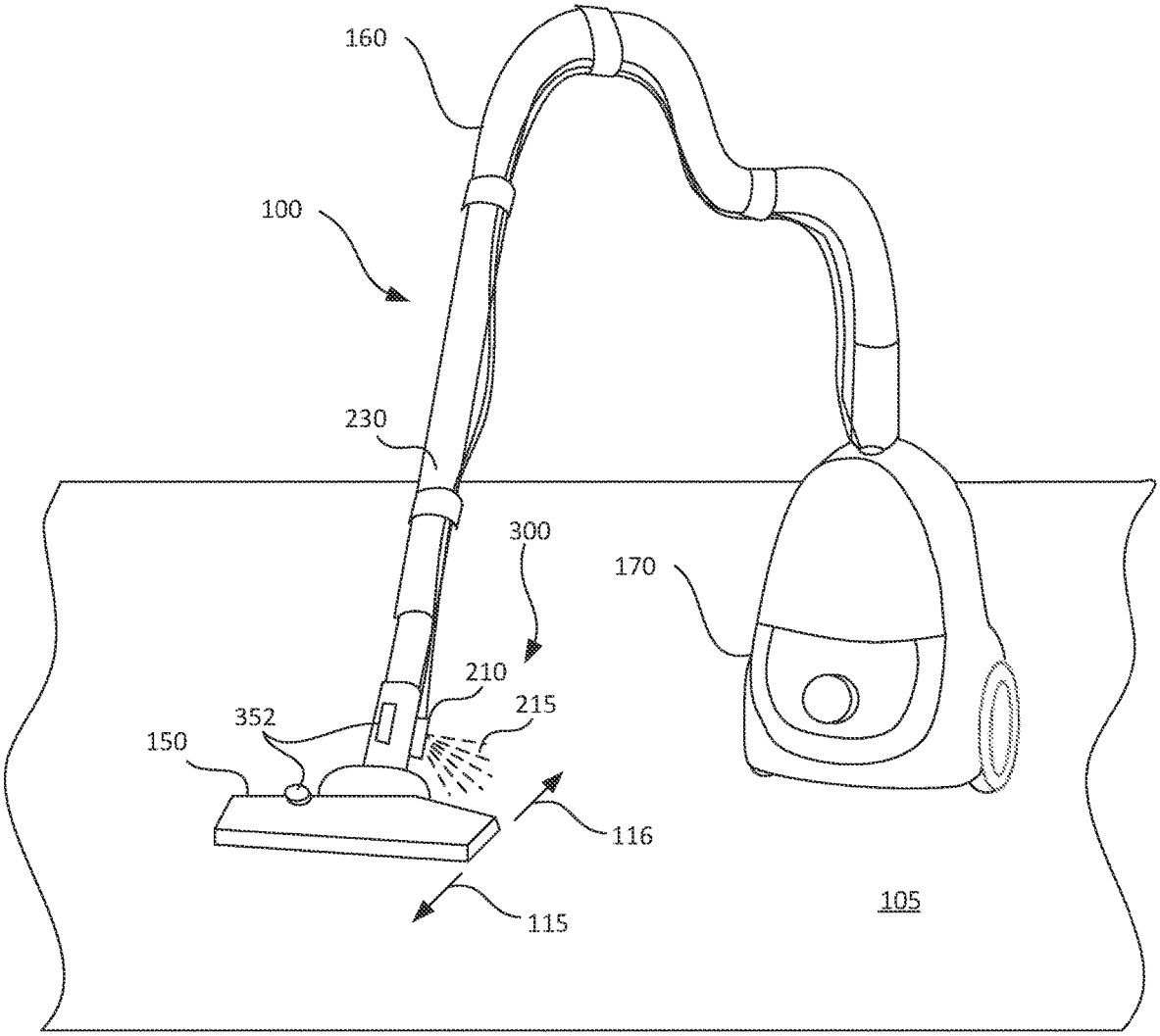

Reference is now made to FIGS. 1A, 1B and 1C showing simplified drawings of example microbe spreading devices integrated with a vacuum cleaner in accordance with some example embodiments. A vacuum cleaner 101 may include a base 170, a suction head piece 150 and a hose 160 connecting base 170 to suction head piece 150. In some example embodiments, a spray nozzle 210 may be positioned on suction head piece 150 (FIG. 1A and FIG. 1B) or optionally on hose 160 near the suction head piece 150 (FIG. 1C). Typically, while a user operates vacuum cleaner 101, the user may move suction head piece 150 in a forward direction 115 and in a backwards direction 116 across a surface 105. In some example embodiments, spray nozzle 210 is positioned to spray a solution 215 in a backwards direction 116 while suction head piece 150 is moving in the forward direction 115 (FIG. 1A and FIG. 1C). In other example embodiments, one or more spray nozzles 210 may be positioned to spray solution 215 in a generally lateral direction with respect to forward direction 115 and backwards direction 116 (FIG. 1B), e.g. at right angles with forward direction 115. In this manner, an area that has already been cleaned may be sprayed with solution 215 and solution 215 may be substantially maintained on the surface 215 after vacuuming cleaning.

Surface 105 may be for example a rug or carpet. Typically, allergens, dust mites and other irritants and contaminants are known to accumulate on rugs and carpets. Solution 215 may be water or oil based solution including environmental friendly microbes. When spraying solution 215 on surface 105, the environmental friendly microbes may compete with such irritants for space and food and thereby suppress their growth over time. Optionally, solution 215 may additionally include aroma compounds to provide fragrance.

While, spray nozzle 210 may be positioned near or on the suction head nozzle piece 150, additional components of the microbe spreading device 300, e.g. a cartridge storing the solution, an actuator for actuating the spraying may be housed in base 170. Optionally, a tube 230 provides fluid communication between components of the microbe spreading device 300 housed in base 170 and spray nozzle 210. Optionally, one or more sensors 352 may be positioned on or near suction head piece 150. One or more sensors 352 may include for example an image sensor, a movement sensor, an airflow sensor or other sensor that may provide information based on which spray nozzle 210 may be actuated.

Figure 2A:
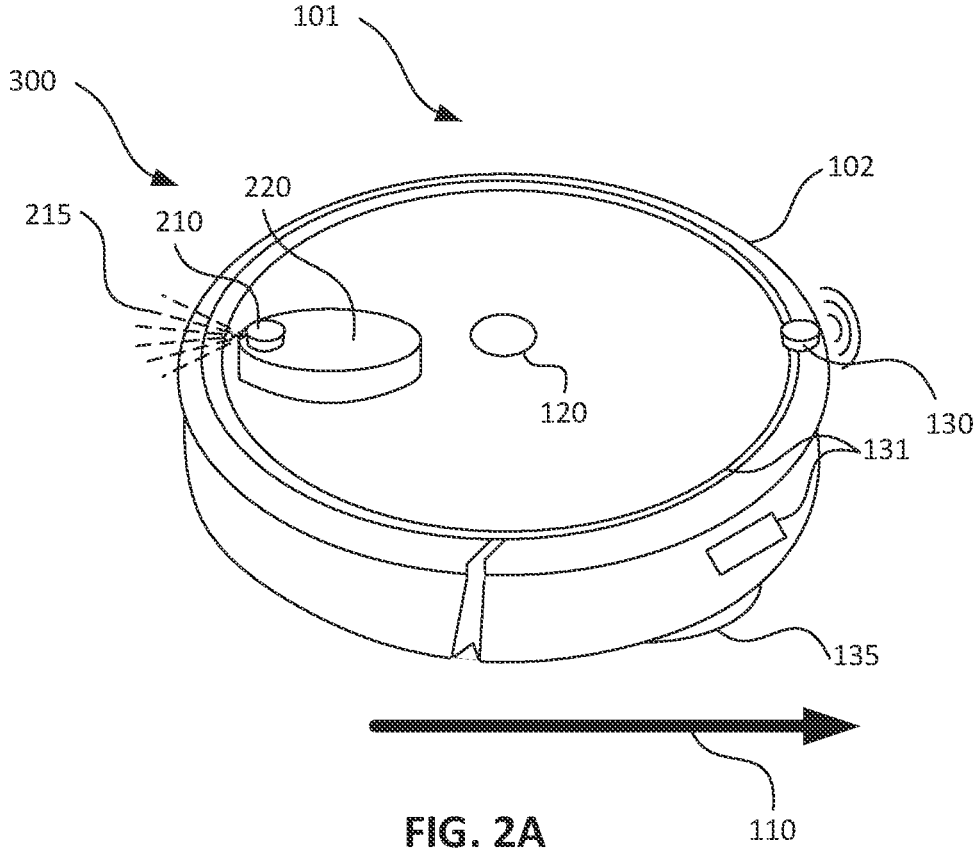
FIGS. 2A and 2B are simplified drawings of example microbe spreading devices integrated with an autonomous robotic vacuum cleaner in accordance with some example embodiments.
Figure 2B:
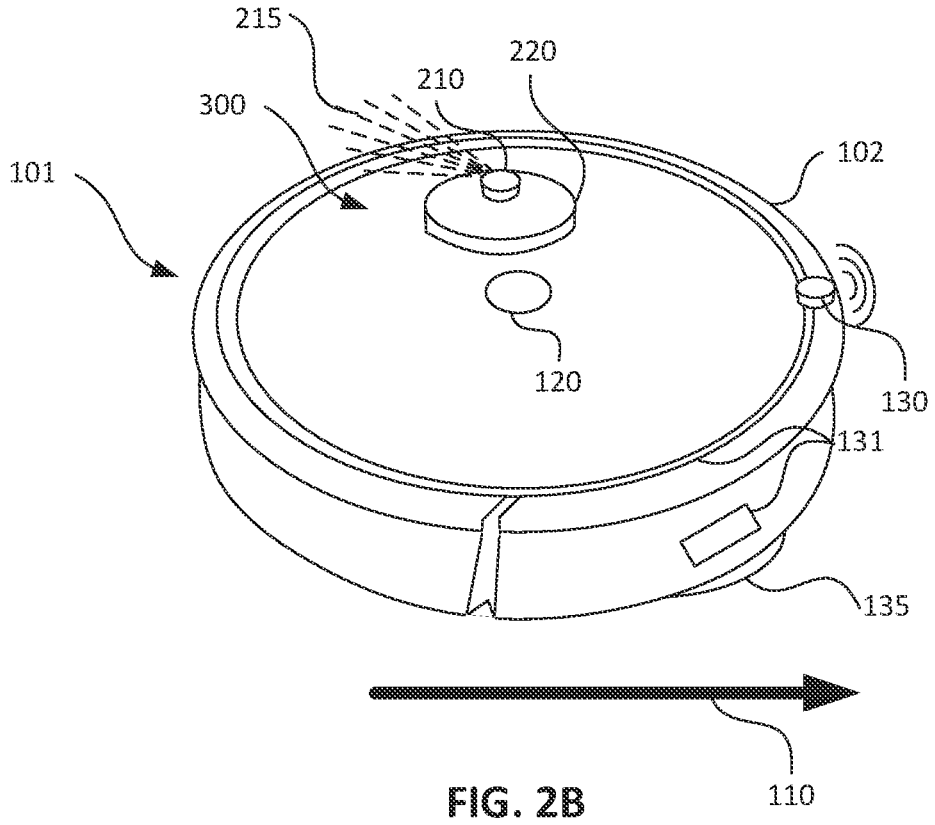

Reference is now made to FIGS. 2A and 2B showing simplified drawings of example microbe spreading devices integrated with an autonomous robotic vacuum cleaner in accordance with some example embodiments. An autonomous robotic vacuum cleaner 101 may typically include housing 102 with a power button 120, wheels 135, brushes, a suction nozzle and a location sensor 130 configured to sense the surrounding environment. Autonomous robotic vacuum cleaner 101 may also include additional sensors 131, e.g. a force sensor, cliff sensor, and a light touch sensor. Generally, robotic vacuum cleaner 101 is configured to move while location sensor 130 is facing in the moving direction 110. According to some example embodiments, a microbe spreading device 300 may be integrated on housing 102 so that a spray nozzle 210 sprays solution 215 away from the direction of movement 110. Optionally, spray nozzle 210 may be positioned to spray in a direction opposite the direction movement 110 (FIG. 2A). Alternatively or additionally, spray nozzle 210 may be positioned to spray in a direction that is lateral to direction of movement 110, e.g. at right angles with respect to direction 110.

According to some example embodiments, a cartridge 220 including solution 215 may be housed in or on housing 102. Additionally components of microbe spreading device 300 including a controller for controlling actuation of spray nozzle 210, an actuator for actuating the spraying and one or more dedicated sensors may be housed in or positioned on housing 101. According to some example embodiments, spray nozzle 210 may be actuated based on output from sensors 130, 131 and may also be actuated based on dedicated sensors associated with microbe spreading device 300.

Figure 3:
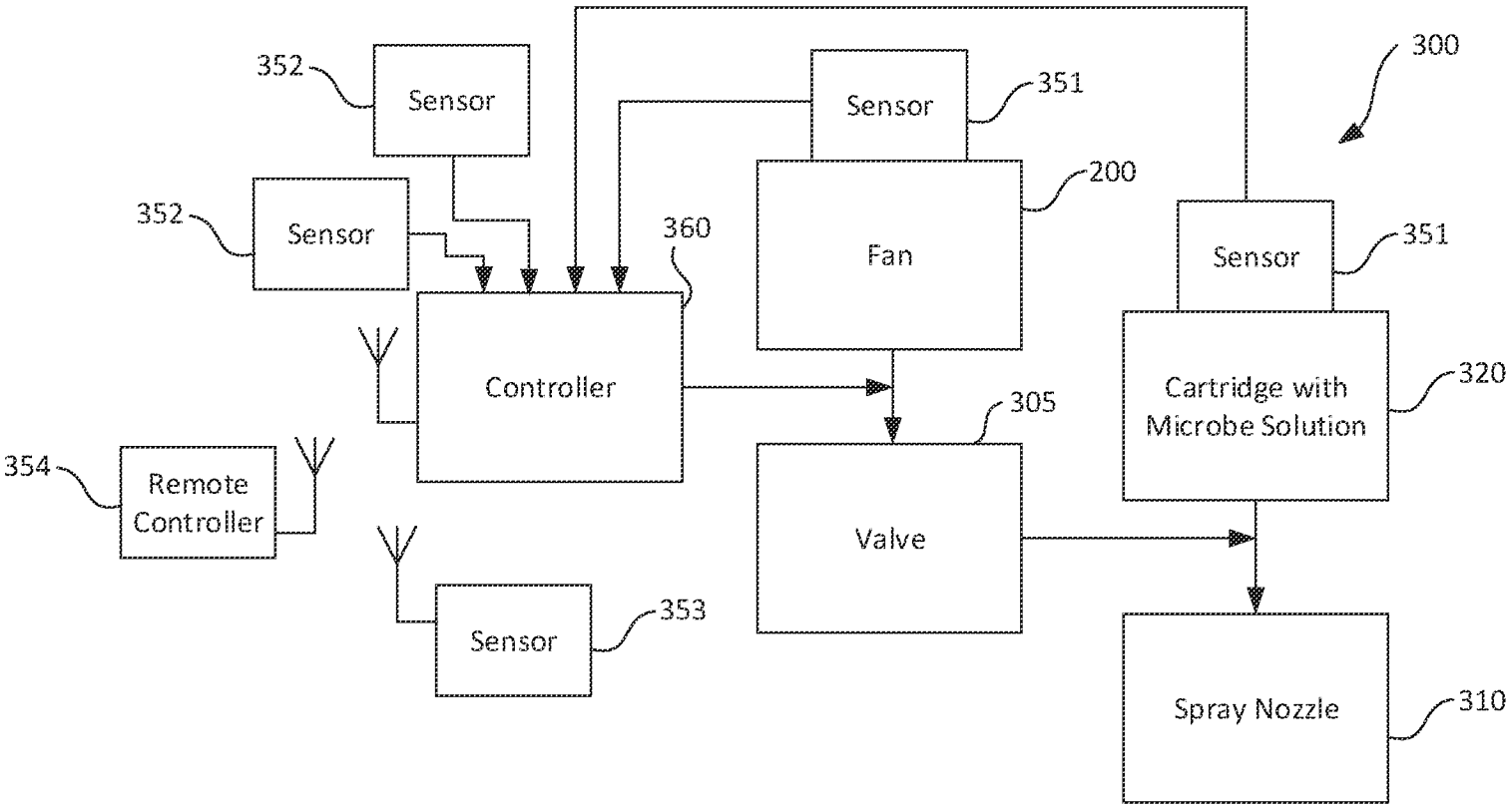
FIG. 3 is a simplified block diagram of an example microbe spreading device configured to be operated with a fan of a vacuum cleaner in accordance with some example embodiments.

Reference is now made to FIG. 3 showing a simplified block diagram of an example microbe spreading device configured to be operated with a fan of a vacuum cleaner in accordance with some example embodiments. According to some example embodiments, microbe spreading device 300 includes a spray nozzle 310, a cartridge 320 configured to store a microbe solution, a valve 305 configured to direct a jet of air toward a nebulizer for atomizing the microbe solution stored in cartridge 320 and a controller 360 configured to control valve 305. In some example embodiments, the jet of air is received from a fan 200 of the vacuum cleaner with which the suction is generated. In other example embodiments, microbe spreading device 300 may additionally include a dedicated actuator for controllably actuating atomization of the microbe solution.

According to some example embodiments controller 360 receives input from one or more sensors. The sensors may be sensors 351 configured to sense an operating condition of microbe spreading device 300. Optionally, sensor 351 includes a sensor for sensing when fan 200 is being operated. Optionally sensor 351 includes a sensor for sensing level of solution in cartridge 320. In some example embodiments, controller 360 receives input from one or more sensors 352 positioned on the vacuum cleaner and configured to sense the surrounding environment. Optionally sensor 352 includes a camera configured to differentiate between hard floors and rugs, carpets and other textile materials. Optionally, controller 360 is configured to operate microbe spreading device 300 based on sensing that the vacuum cleaner is cleaning a textile materials, e.g. a carpet and refrain from operating operate microbe spreading device 300 based on sensing that the vacuum cleaner is cleaning a hard floor. Optionally sensor 352 includes a motion sensor. For example, a motion sensor 3522 positioned on suction head piece 150 (FIG. 1A) may provide indication of forward movement 115 and backwards movement 116 and controller 160 may only actuate the spraying during forward movement 115 or suction head piece 150.

In some example embodiments, controller 360 may also receive input from one or more remote sensors 353 and/or from a remote controller 354 via a wireless communication channel. Optionally, ON/OFF operation of microbe spreading device 300 and frequency at which microbe spreading device 300 sprays the microbe solution may be controlled with controller 360 based on input from one or more of the various sensors 351, 352, 353 and remote controller 354.

Figure 4:
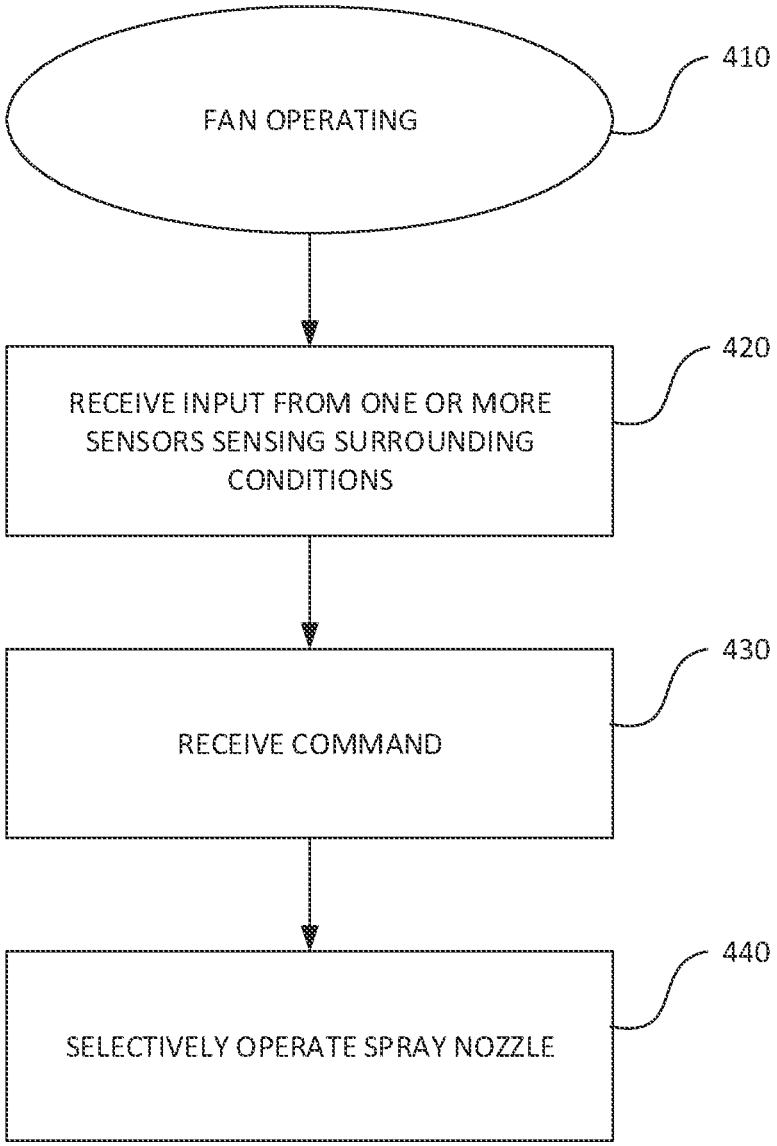
FIG. 4 is a simplified flow chart of an example method for operating an example microbe spreading device with a vacuum cleaner in accordance with some example embodiments.

Reference is now made to FIG. 4 showing a simplified flow chart of an example method for operating an example microbe spreading device with a vacuum cleaner in accordance with some example embodiments. According to some example embodiments, while a fan is being operated by the vacuum cleaner the microbe spreading device 300 may be operated (block 410). Optionally, operation is based on receiving input from one or more sensors sensing a surrounding condition (block 420). The surrounding condition may sense what type a surface is currently being cleaned by the vacuum cleaner and direction of movement of the vacuum cleaner. Optionally, operation is based on receiving a command from a user to activate the spraying (block 430). In some example embodiments, the spray nozzle for spraying the microbe solution is selectively controlled based on input received from the one or more sensors and/or from a command provided by the user (block 440).

Figure 5:
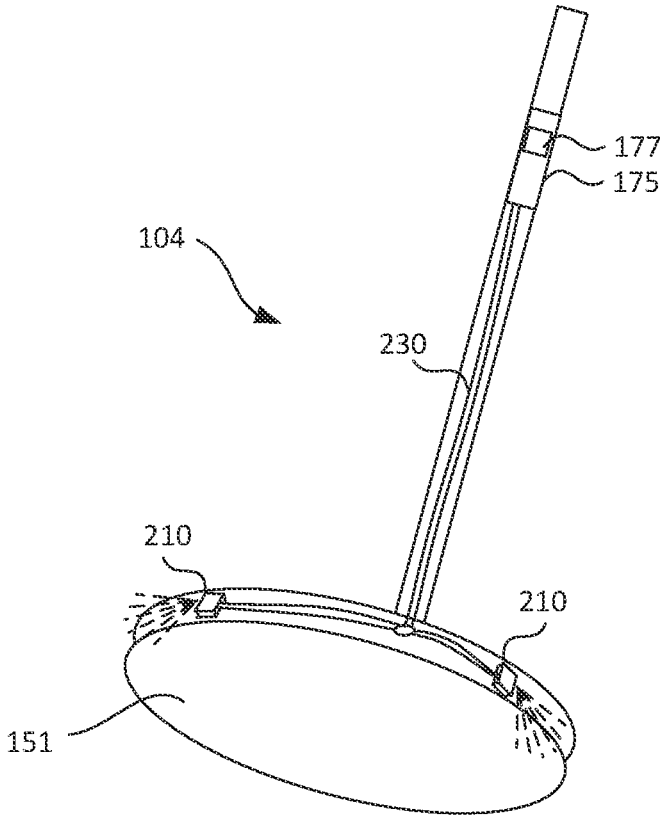
FIG. 5 is a simplified drawing of an example microbe spreading devices integrated with a cleaning device in accordance with some example embodiments.

Reference is now made to FIG. 5 showing a simplified drawing of an example microbe spreading devices integrated with a cleaning device in accordance with some example embodiments. Cleaning device 104 may be for example a broom or a mop. According to some example embodiments, a spray nozzle 210 may be positioned on or near a cleaning platform 151 of device 104 and may be operated while cleaning device 104 is cleaning a surface. An actuator for actuating the spraying and optionally for housing the cartridge with the solution may be housed in a housing 175. Optionally a tube 230 provides fluid communication between components of the microbe spreading device housed in housing 175 and spray nozzle 210. Optionally, microbe spreading device is operated in an automated mode when an operating switch 177 is turned on. During automated mode, the microbe spreading device actuates spraying at defined intervals.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

In addition, any priority document(s) of this application is/are hereby incorporated herein by reference in its/their entirety.

What is claimed is:

1. A device comprising:

a fan configured to create a suction;

a suction nozzle configured to clean a flat surface or object based on operation of the fan;

a housing configured to house the suction nozzle;

a cartridge configured to store a solution of environmental friendly microbes;

a spray nozzle positioned on the housing and configured to disperse the environmental friendly microbes on the flat surface or object as it is being cleaned;

a valve configured to direct jets of air from the fan to the spray nozzle and thereby actuate dispersing the environmental friendly microbes;

a sensor for sensing air quality of a room in which said cleaning is taking place, and a controller configured to selectively operate the valve in coordination with the suction nozzle to disperse the environmental friendly microbes on areas of the flat surface or object that have already been cleaned, the controller further configured to actuate the spray nozzle based on the air quality sensed.

2. The device of claim 1, wherein the coordination is configured to provide maintaining the environmental friendly microbes on the flat surface or object after the flat surface or object is cleaned.

3. The device of claim 2, wherein the solution includes an aroma compound configured to provide a fragrance.

4. The device of claim 1, further comprising a motion sensor configured to sense a direction of movement of the housing during cleaning and wherein the spray nozzle is positioned to direct the spray in a direction opposite the direction of movement of the housing.

5. The device of claim 4, wherein the spray nozzle is positioned to direct the spray laterally with respect to the direction of movement of the housing.

6. The device of claim 1 comprising an additional sensor, wherein the controller is further configured to receive input from the additional sensor and to control operation of the valve based on the input.

7. The device of claim 6, wherein the additional sensor is configured to sense that the fan is operative.

8. The device of claim 6, wherein the additional sensor is a level sensor configured to sense a level of the solution in the cartridge.

9. The device of claim 6, wherein the additional sensor is a camera configured to detect that the device is cleaning a textile surface.

10. The device of claim 9, wherein the controller is configured to operate the valve based on the additional sensor detecting the textile surface.

11. The device of claim 6, wherein the additional sensor is configured to differentiate between a hard surface and a textile surface.

12. The device of claim 6, wherein the additional sensor is remote from the device and wherein the controller is configured to receive the input via a wireless communication channel.

13. The device of claim 12, wherein the additional sensor is a humidity detector or a temperature sensor.

14. The device of claim 6, wherein the controller is configured to alter a frequency of the spraying based on the input.

15. The device of claim 6, wherein the controller is configured to alter a dose of the spraying based on the input.

16. The device of claim 1, wherein the cartridge is configured to be replaced based on the solution being exhausted.

17. The device of claim 1, wherein the device is a vacuum.

18. A method for operating a microbe spreading device with a suctioning device, the method comprising:

actuating a suctioning device for cleaning a flat surface or object;

sensing air quality of a room wherein said cleaning takes place;

actuating a spray nozzle configured to spray a solution including environmental friendly microbes with a fan of the suctioning device, said actuating the spray nozzle being based on the air quality sensed;

coordinating actuating the spray nozzle with actuating the suctioning device to effect dispersing the environmental friendly microbes on portions of the flat surface or object that have been cleaned.

19. The method of claim 18, wherein the spray nozzle is positioned to direct the spray in a direction opposite a direction of movement of the suction head.

20. The method of claim 18, comprising sensing a direction of motion of the suctioning device and coordinating based on the sensed direction.

21. The method of claim 18, wherein the air quality is sensed remote from the suctioning device and transmitted to the suctioning device via a wireless communication channel.

* * * * *